US010910733B2

(12) United States Patent
Miyamoto et al.

(10) Patent No.: US 10,910,733 B2
(45) Date of Patent: Feb. 2, 2021

(54) TERMINAL FITTING

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Kenji Miyamoto, Mie (JP); Kazuaki Hamada, Mie (JP); Eiji Kojima, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 262 days.

(21) Appl. No.: 16/086,025

(22) PCT Filed: Mar. 2, 2017

(86) PCT No.: PCT/JP2017/008247
§ 371 (c)(1),
(2) Date: Sep. 18, 2018

(87) PCT Pub. No.: WO2017/163803
PCT Pub. Date: Sep. 28, 2017

(65) Prior Publication Data

US 2020/0295471 A1 Sep. 17, 2020

(30) Foreign Application Priority Data

Mar. 23, 2016 (JP) ..... 2016-057926

(51) Int. Cl.
*H01R 4/18* (2006.01)
*H01R 9/05* (2006.01)
*H01R 13/658* (2011.01)

(52) U.S. Cl.
CPC ..... *H01R 4/18* (2013.01); *H01R 9/05* (2013.01); *H01R 13/658* (2013.01)

(58) Field of Classification Search
CPC ..... H01R 4/18; H01R 13/658
(Continued)

(56) References Cited

U.S. PATENT DOCUMENTS 6,265,664 B1 * 7/2001 Sakaguchi ..... H01R 4/024 174/78
6,384,335 B1 5/2002 Saito et al.
(Continued)

FOREIGN PATENT DOCUMENTS

JP 2000-323246 11/2000
JP 2002-208461 7/2002
(Continued)

OTHER PUBLICATIONS

International Search Report dated May 30, 2017.

*Primary Examiner* — Jean F Duverne
(74) *Attorney, Agent, or Firm* — Gerald E. Hespos; Michael J. Porco; Matthew T. Hespos

(57) ABSTRACT

It is aimed to enhance efficiency in connecting operation to a shielded cable and prevent the impairment of a shielding function. A terminal fitting (T) includes an inner conductor (6) including core crimping portions (9) to be crimped to a core (1), a dielectric (7) made of an insulating material, an outer conductor (5) including a body portion (12) configured to surround the dielectric (7), a braided wire crimping portion (22) crimpable to a braided wire and a coupling portion (15) configured to connect the body portion (12) and the braided wire crimping portion (22), parts of the coupling portion corresponding to the core crimping portions (9) being vertically opened, and a cover member (8) configured to close both openings (18, 19) of the coupling portion (15).

5 Claims, 10 Drawing Sheets

(58) Field of Classification Search
USPC ..... 439/585
See application file for complete search history.

(56) References Cited

U.S. PATENT DOCUMENTS

| | | | | |
|---|---|---|---|---|
| 2003/0224656 | A1 | 12/2003 | Yoshida | |
| 2008/0014792 | A1 | 1/2008 | Chen et al. | |
| 2010/0112858 | A1* | 5/2010 | Takayama | H01R 9/0518<br>439/585 |
| 2013/0319761 | A1* | 12/2013 | Furukawa | H01R 43/048<br>174/74 R |
| 2018/0026401 | A1* | 1/2018 | Kanda | H01R 13/6473<br>439/607.5 |
| 2018/0198266 | A1* | 7/2018 | Inoue | H01R 13/115 |
| 2020/0052445 | A1* | 2/2020 | Maesoba | H01R 13/648 |
| 2020/0194937 | A1* | 6/2020 | Maesoba | H01R 13/6581 |

FOREIGN PATENT DOCUMENTS

| | | |
|---|---|---|
| JP | 2003-297493 | 10/2003 |
| JP | 2009-252356 | 10/2009 |
| JP | 2013-222685 | 10/2013 |

* cited by examiner

TERMINAL FITTING

BACKGROUND

Field of the Invention

The invention relates to a terminal fitting to be connected to an end of a shielded cable.

Related Art

Unexamined Japanese Patent Publication No. 2002-208461 discloses a terminal fitting to be connected to an end part of a shielded cable. An outer sheath, a braided wire and an inner sheath are stripped on the end part of the shielded cable to expose a core located in a central part. The inner sheath is exposed behind the core, and an exposed part of the braided wire is connected to the outer sheath on an outermost layer.

The terminal fitting is composed of an inner conductor, a dielectric and an outer conductor. The terminal fitting is connected to the shielded cable by connecting the inner conductor to the exposed core separately from the outer conductor. A connecting operation is performed by crimping two barrel pieces of the inner conductor to the core. The dielectric is accommodated into the outer conductor and two barrel pieces of the outer conductor are crimped to the outer sheath. In this way, the connection of the terminal fitting to the shielded cable is completed.

As described above, a conventional terminal fitting connection procedure goes through two crimping processes including a crimping process of crimping the inner conductor to the core and a crimping process performed after the former crimping process to crimp the outer conductor to the outer sheath. Thus, to further enhance manufacturing efficiency, it is thought to perform the two crimping processes described above at once.

Such a crimping operation may be enabled by crimping the inner conductor to the core with the inner conductor incorporated into the outer conductor. Specifically, the crimping operation is performed by a caulking apparatus including an anvil and a crimper vertically facing each other. Thus, the outer conductor is opened vertically at a position corresponding to a crimped part of the inner conductor and the core. By doing so, the anvil and the crimper can enter the inside of the outer conductor through both openings and crimp the core.

However, the openings provided in the outer conductor for the crimping operation adversely affect a noise reducing or shielding function of the terminal fitting.

The invention was completed on the basis of the above situation and aims to provide a terminal fitting capable of being efficiently connected to a shielded cable without impairing a shielding function at all.

SUMMARY

A terminal fitting of the present invention includes an inner conductor made of conductive metal. The inner conductor includes a core crimping portion to be crimped to a core exposed on an end of a shielded cable. The terminal fitting also includes a dielectric made of an insulating material and accommodating the inner conductor. The terminal fitting further includes an outer conductor with a body configured to surround the dielectric, a braided wire crimping portion that is crimpable to a braided wire exposed by removing an outer sheath on the end of the shielded cable over a predetermined range, and a coupling configured to connect the body and the braided wire crimping portion. Parts of the coupling corresponding to the core crimping portion have openings that are open in both directions along a crimping direction of the core crimping portion. A cover is made of conductive metal and is configured to close both openings of the coupling portion.

According to the invention, the parts of the coupling of the outer conductor corresponding to the core crimping portion of the inner conductor are opened in both directions. Thus, a crimping operation can be performed for the core of the shielded cable and the core crimping portion of the inner conductor through these openings and, simultaneously, a crimping operation can be performed for the braided wire crimping portion and the braided wire.

Further, although a shielding function may be reduced due to the coupling portion of the outer conductor opened in the both directions, a reduction of the shielding function can be avoided since both openings are closed by the cover.

The braided wire crimping portion may be composed of two braided wire barrel pieces, and the cover member may be formed with a rear-side holding portion to be crimped to the braided wire barrel pieces from outside in a state where the braided wire is crimped. According to this configuration, the rear-side holding portion of the cover is crimped to the braided wire barrel pieces that are crimped to the braided wire. Thus, a positional deviation of the cover is avoided, and the opening of the braided wire barrel pieces is prevented thereby contribute to the holding/strengthening of a crimped state to the braided wire.

The cover may be formed with a front-side holding portion to be crimped to an outer peripheral surface of the body. According to this configuration, a part of the body has a double structure that can enhance the rigidity of the body and eventually the entire terminal fitting.

The cover may include a closing plate configured to close one of the openings of the outer conductor, and the front-side holding portion may be formed with two clamping pieces extending forward from a front end of the closing plate. The clamping pieces may protrude in a width direction and may be crimped to the outer peripheral surface of the body. Two closing arms may extend rearward within a width of the front-side holding portion from rear edges of the clamping pieces. The closing arms may be configured to close the other of the openings of the outer conductor as the clamping pieces are crimped. According to this configuration, the openings of the outer conductor can be closed by the closing plate and the closing arms that are integral to the cover. Further, since the closing arms are formed within the width of the front-side holding portion, a yield increase can also be expected.

The shielded cable may be such that an inner sheath is exposed over a predetermined range between the core and the braided wire both in an exposed state. At least one of the openings of the outer conductor may be open over a range including the core crimping portion and an exposed part of the inner sheath. Additionally, the cover may close both openings to conceal the core crimping portion and the exposed part of the inner sheath. According to this configuration, the inner sheath is interposed between the core and the braided wire, both of which are in the exposed state. Thus, the inner sheath avoids a short circuit between the core and the braided wire. As a result of having this configuration, even if at least one of the openings of the coupling of the outer conductor is open to expose parts of the core and the inner sheath, the shielding function is not impaired in the inner sheath exposed part since the cover closes the openings to conceal the inner sheath part.

DETAILED DESCRIPTION

Hereinafter, a specific embodiment of the invention is described with reference to the drawings.

Figure 2:
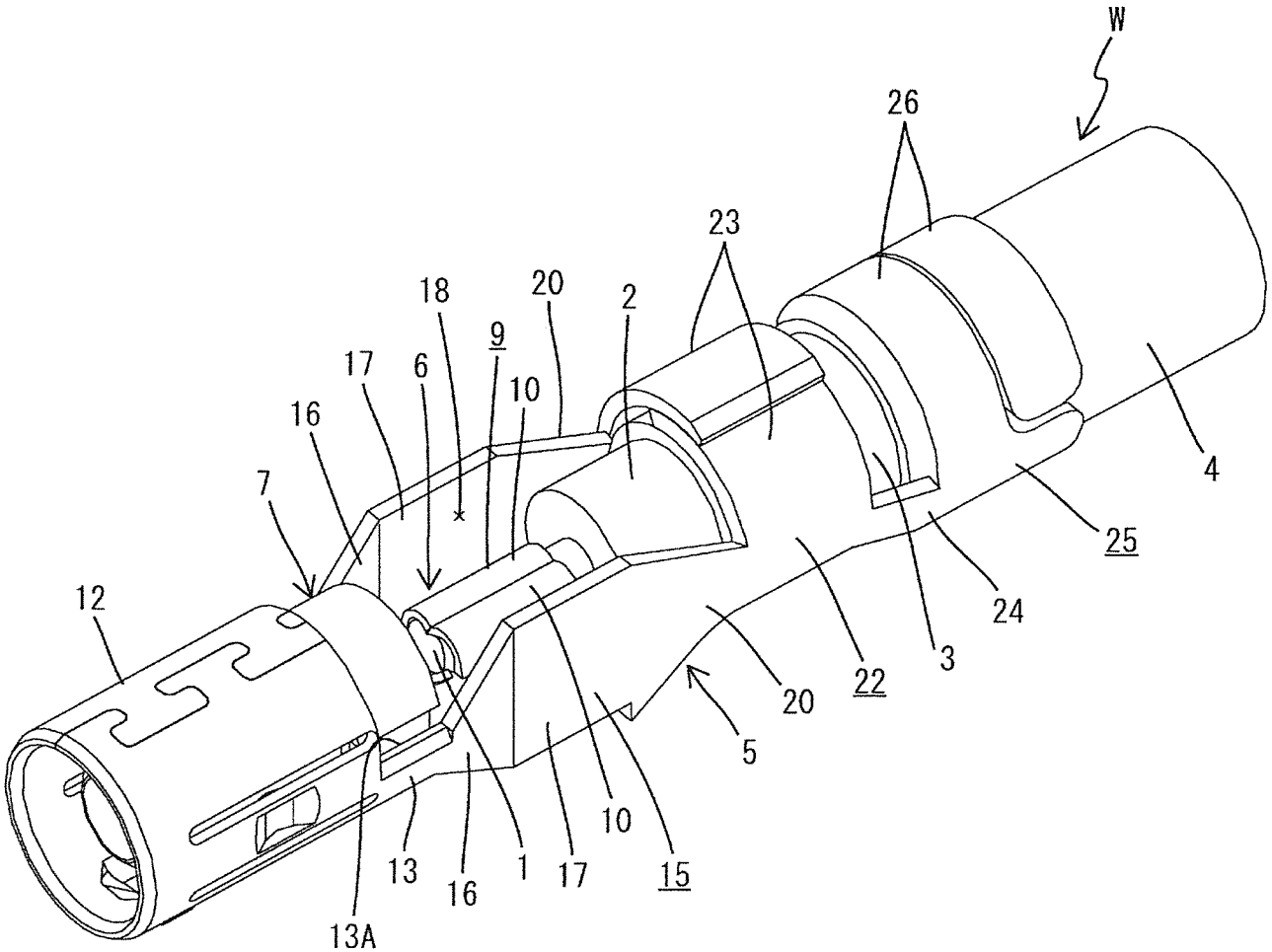
FIG. 2 is a perspective view showing a state after connection to the shielded cable and before a cover member is mounted.

First, a shielded cable W is described on the basis of FIG. 2. The shielded cable W has a known structure with a core 1 in a central part, an inner sheath 2 and a braided wire 3 are successively disposed outside the core 1, and an outer sheath 4 is disposed on an outermost layer. As shown in FIG. 2, the core 1 is exposed on an end of the shielded cable W, and the inner sheath 2 is exposed over a predetermined length range behind the exposed core 1. Further, the braided wire 3 is exposed behind this exposed inner sheath 2 and is continuous with the outer sheath 4. The inner sheath 2 is interposed between the braided wire 3 and the core 1 to avoid a short circuit between the braided wire 3 and the core 1.

(Terminal Fitting T)

Figure 1:
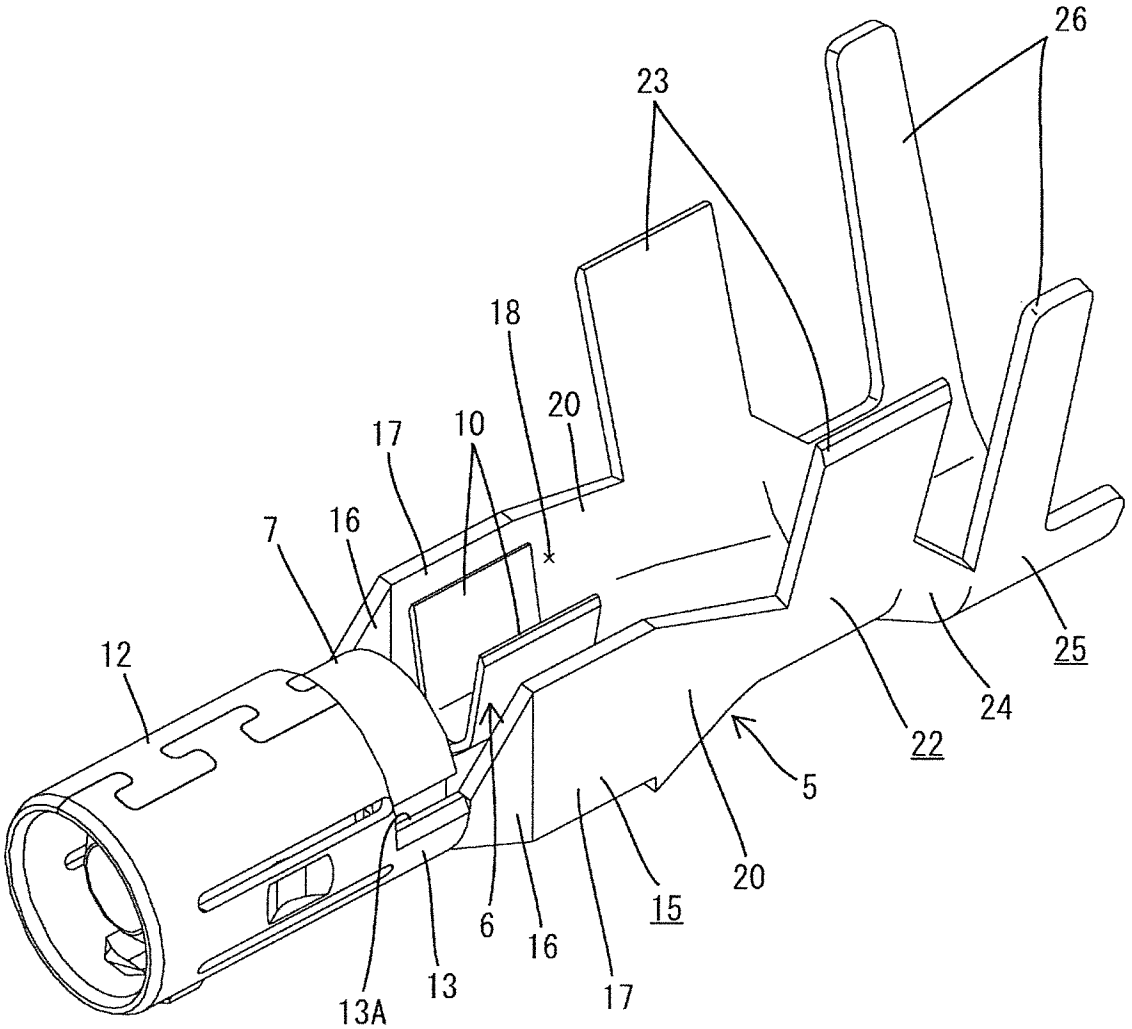
FIG. 1 is a perspective view of a terminal fitting before connection to a shielded cable.

The terms "upper" and "lower" used to describe the terminal fitting T are based on FIG. 1 below.

Figure 5:
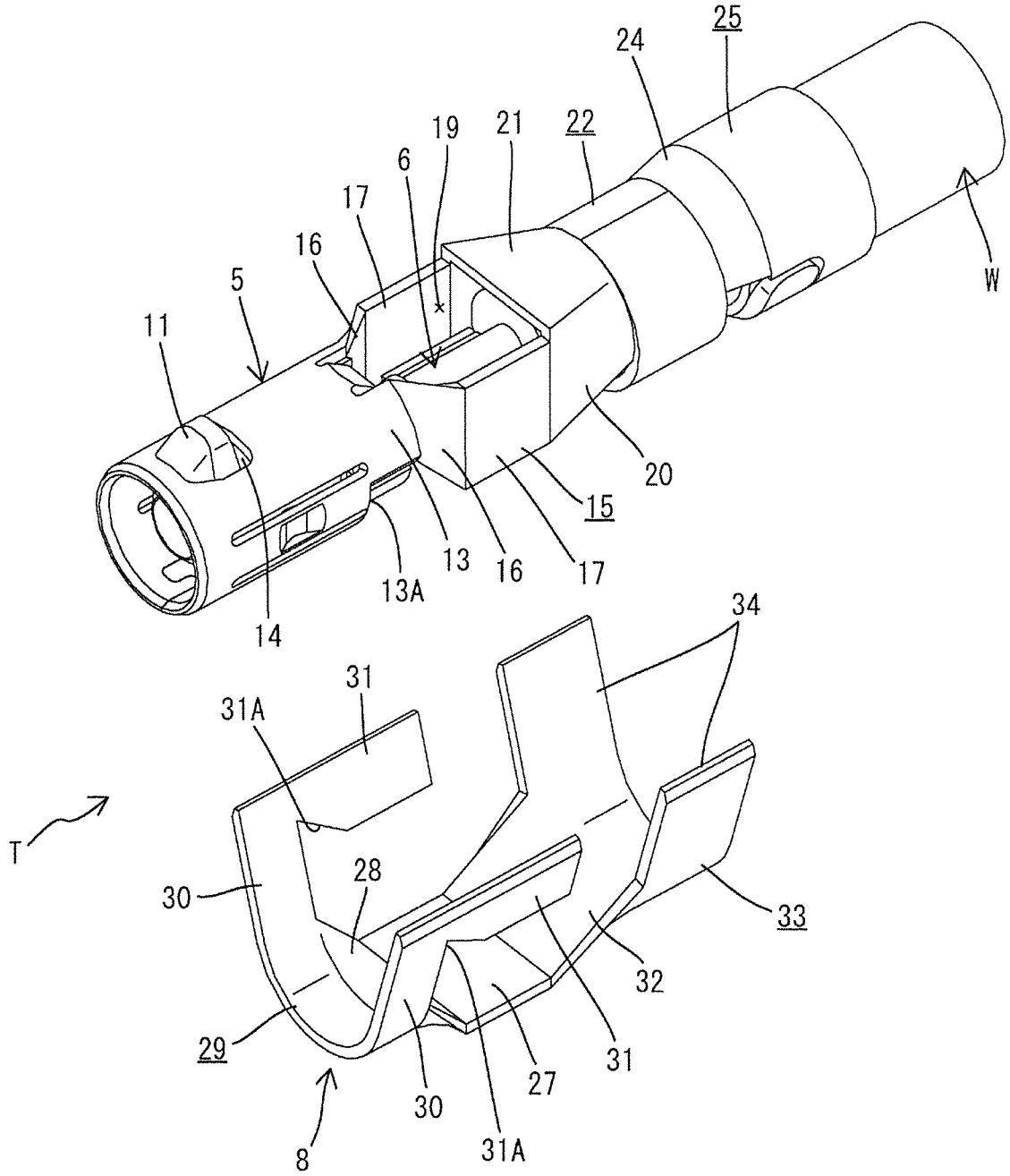
FIG. 5 is a perspective view showing a status of a cover member mounting operation.

As shown in FIGS. 2 and 5, the terminal fitting T is composed of an outer conductor 5 and an inner conductor 6, both of which are made of conductive metal. A dielectric 7 and a cover member 8 are interposed between the inner and outer conductors 5 and 6 and are made of an insulating material (synthetic resin).

The inner conductor 6 is formed by bending a thin plate material and includes a tubular portion (not shown) for connection to a mating terminal fitting. The tubular portion is formed to be open in an axial direction. Two core crimping portions 9 extend rearward from the bottom surface of the tubular portion. Each core crimping portion 9 is formed with a standing barrel piece 10. The core 1 is placed between the barrel pieces 10 and connected to the inner conductor 6 by caulking. A caulking operation is performed by an unillustrated crimping machine that has a crimper and an anvil arranged to face each other vertically.

The dielectric 7 has a cylindrical outer shape and the tubular portion of the inner conductor 6 can be accommodated therein. With the inner conductor 6 accommodated in the dielectric 7, the core crimping portions 9 project rearward. Further, a locking protrusion 11, as shown in FIG. 5, projects on a lower surface side of the dielectric 7 near a front end part.

Similar to the inner conductor 6, the outer conductor 5 also is formed of a thin plate material. A body 12 is provided in a front part of the outer conductor 5 and is configured to surround and retain the dielectric 7. The body 12 has a hollow cylindrical shape that is open in the axial direction, and a substantially upper circumferential half area of a rear end part is cut to form a semi-circumferential portion 13, thereby exposing an upper half of a rear part of the dielectric 7. Further, a through hole 14 is open in the lower surface of the body 12 near the front. The locking protrusion 11 of the dielectric 7 projects out through this through hole 14.

A coupling 15 is continuous with a rear part of the outer conductor 5 and extends rearward. The coupling 15 has left and right front linking walls 16 that extend continuously and substantially straight rearward from the rear end edge of the semi-circumferential portion 13 in the outer conductor 5. The front linking walls 16 gradually increase in height toward the rear, and left and right side walls 17 are continuous with the rear ends of the front linking walls 16.

The side walls 17 are vertical and parallel to each other while extending along the front-rear direction. A communication space between the front linking walls 16 and between the side walls 17 constitutes openings 18 and 19 that open both up and down. The core crimping portions 9 of the inner conductor 6 are located between the side walls 17 and substantially in a center of the vertically open space when the inner conductor 6 and the dielectric 7 are assembled with the outer conductor 5.

Rear linking walls 20 are continuous from the rear ends of the side walls 17 in the coupling 15. The rear linking walls 20 extend rearward along the front-rear direction. The front ends of the upper edges of the rear linking walls 20 are connected to the upper end edges of the side walls 17 and gradually slope down toward the rear from there.

As shown in FIG. 5, the rear linking walls 20 are connected by a bottom plate 21. Thus, a space between the rear linking walls 20 opens only up. When the shielded cable W is set temporarily in the terminal fitting T, the inner sheath 2 exposed in the shielded cable W is located entirely between the rear linking walls 20 and substantially within a length range corresponding to the rear linking walls 20 in the front-rear direction.

A braided wire crimping portion 22 is continuous with the rear end edges of the rear linking walls 20 and the bottom plate 21. The braided wire crimping portion 22 includes two braided wire barrel pieces 23 and can be caulked to the braided wire 3 exposed in the shielded cable W. As shown in FIG. 2, the braided wire barrel pieces 23 are crimped so that their end parts overlap in a thickness direction.

An outer sheath crimping portion 25 is continuous from the rear end edge of the braided wire crimping portion 22 via a connecting portion 24. The outer sheath crimping portion 25 includes two outer sheath barrel pieces 26 that are shifted in the front-rear direction in this embodiment. When an end part of the outer sheath 4 of the shielded cable W is caulked, the outer sheath barrel pieces 26 are crimped while being offset from each other in the front-rear direction, as shown in FIG. 2.

(Cover Member 8)

The cover 8 is mainly for closing the upper and lower openings 18, 19 of the coupling 15 in the outer conductor 5. The cover 8 is formed of the same type of a thin plate material as the outer conductor 5.

As shown in FIG. 5, the cover member 8 includes a closing plate 27 for tightly closing the upper opening 18 (opening on a side shown in FIG. 1) of the coupling 15 where the side walls 17 are formed. The closing plate 27 has a width to be placed on the upper edges of both side walls 17 of the outer conductor 5 and the same length in the front-rear direction as the side walls 17. A linking closing portion 28 is continuous with the front edge of the closing plate 27. The linking closing portion 28 can close an area of the upper opening 18 between the front linking walls 16 and closes the opening area while being fit tightly to the upper edges of the front linking walls 16.

Figure 6:
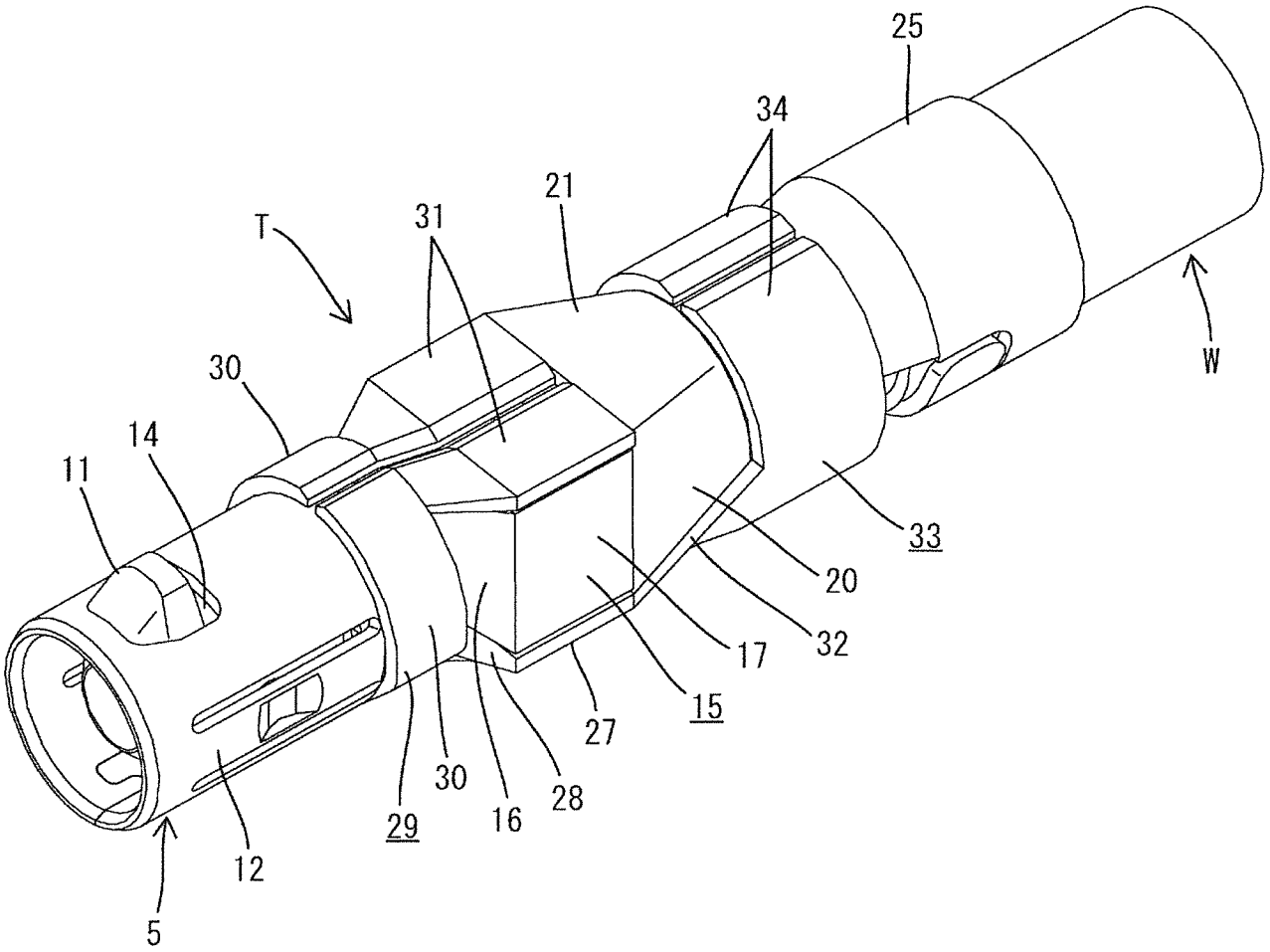
FIG. 6 is a perspective view showing a state where the cover member is mounted.
Figure 7:
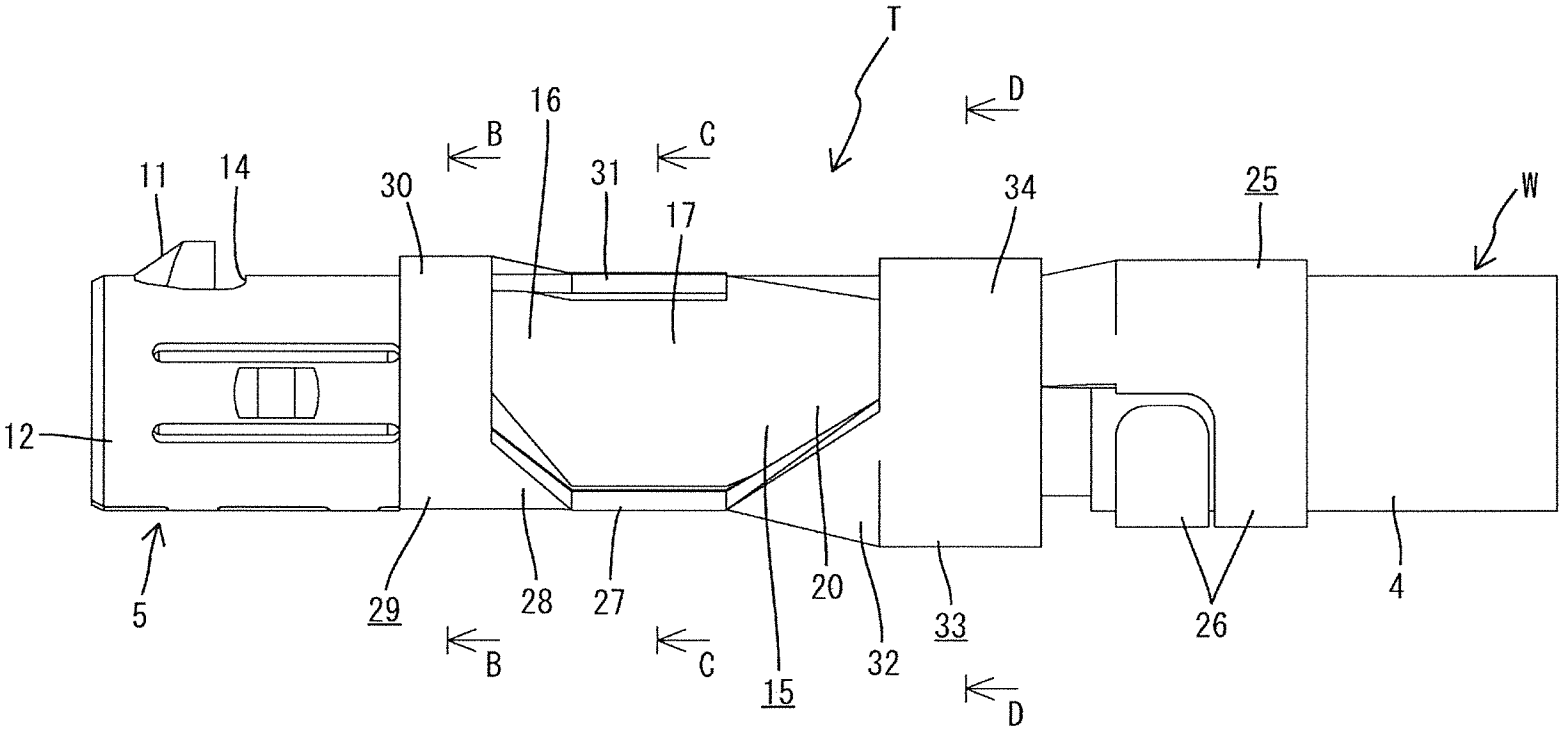
FIG. 7 is a side view of the terminal fitting in the state of FIG. 6.
Figure 8:
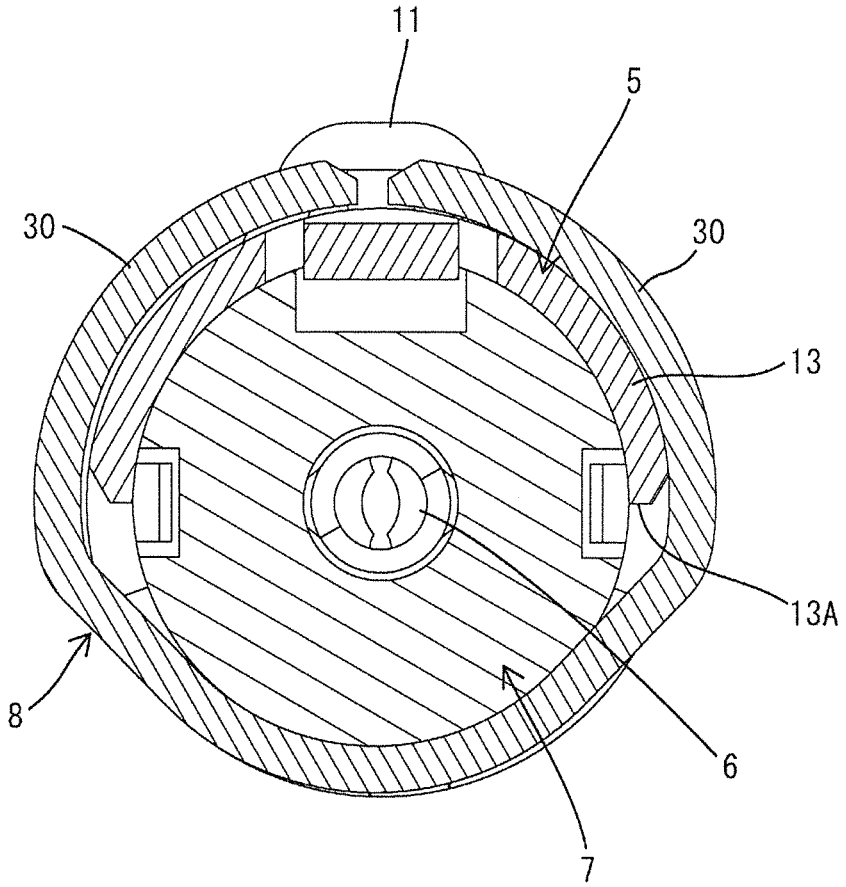
FIG. 8 is a section along B-B of FIG. 7.

A front-side holding portion 29 is continuous with the front edge of the linking closing portion 28. The front-side holding portion 29 is a strip having substantially the same width as the semi-circumferential portion 13 of the body 12 of the outer conductor 5 in the front-rear direction. The front-side holding portion 29 includes two front-side clamping pieces 30 protruding in a width direction from the front edge of the linking closing portion 28. As shown in FIG. 8, the front-side clamping pieces 30 can be crimped to embrace a rear end part of the outer conductor 5, i.e. an entire circumferential portion including both the outer peripheral surface of the semi-circumferential portion 13 and the outer peripheral surface of the dielectric 7 exposed via a cut 13A Two closing arms 31 extend rearward substantially at a right angle from tip parts of the front-side clamping pieces 30. As shown in FIG. 6, the closing arms 31 have end edges thereof facing each other in a longitudinal direction and butted against each other in the front-rear direction. In that state, the lower opening in the coupling 15 can be closed tightly over the entire range. Cuts 31A having a predetermined shape are provided in base end parts of the closing arms 31 so that the closing arms 31 can be fit tightly along the lower end edges of the front linking walls 16 in the outer conductor 5.

On the other hand, a connecting wall 32 extends rearward and is continuous with the rear edge of the closing plate 27. The connecting wall 32 closes an opening area in the rear linking walls 20 of the outer conductor 5 (opening area on a rear side of the opening 18). As shown in FIG. 5, left and right side edges of the connecting wall 32 are sloped up toward the rear as shown so as to extend along the upper edges of the rear linking walls 20 of the outer conductor 5.

A rear-side holding portion 33 is continuous with the rear end edge of the connecting wall 32. The rear-side holding portion 33 includes two rear-side clamping pieces 34 that can be crimped to embrace the braided wire crimping portion 22 (braided wire barrel pieces 23 crimped to the braided wire 3) of the outer conductor 5. As show in FIG. 6, the rear-side clamping pieces 34 are crimped to the outer peripheral surfaces of the braided wire barrel pieces 23 with the tips of the rear-side clamping pieces 34 butting against each other.

Figure 3:
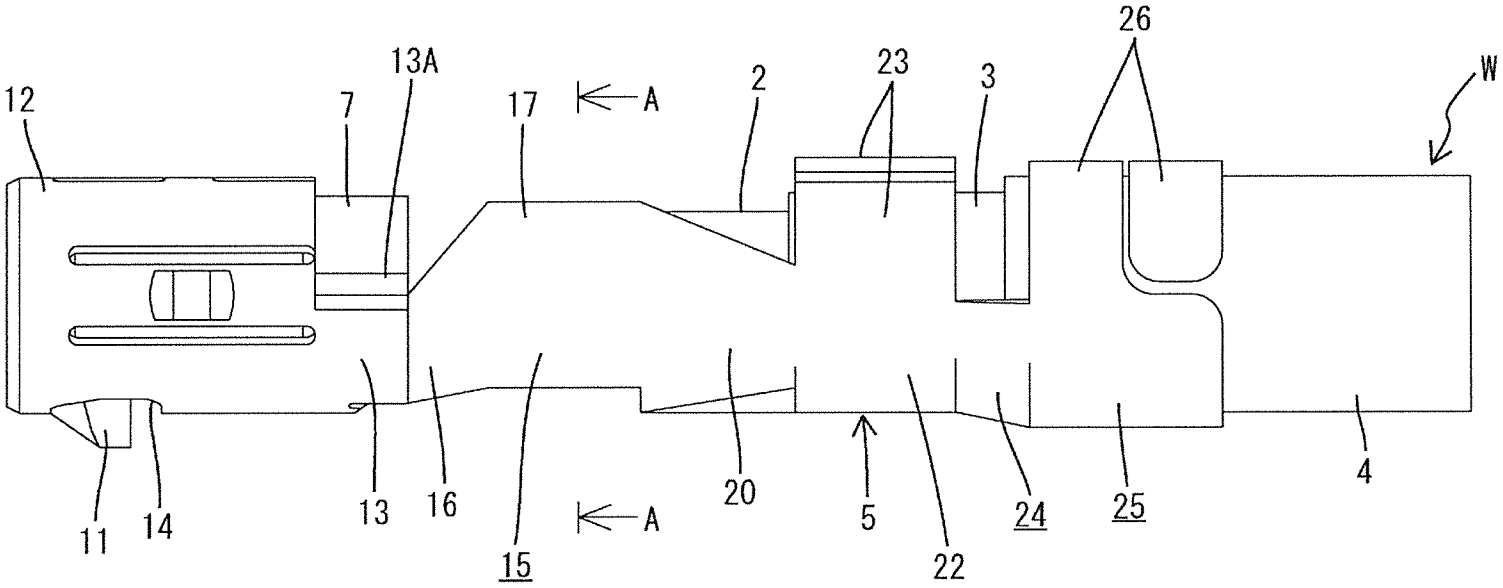
FIG. 3 is a side view of the terminal fitting in the state of FIG. 2.

Next, functions and effects of this embodiment configured as described above are described. In the case of connecting the terminal fitting T to the shielded cable W, the core 1, the inner sheath 2 and the braided wire 3 are exposed successively from the front side in the shielded cable W. On the other hand, the dielectric 7 is accommodated in a retained state inside the outer conductor 5 after or before the inner conductor 6 is incorporated into the dielectric 7. In that state, as shown in FIG. 5, the locking protrusion 11 of the dielectric 7 is fit into the through hole 14 of the outer conductor 5 and projects from the outer periphery of the body 12. Further, as shown in FIG. 3, the rear end surface of the dielectric 7 is substantially flush with the rear end edge of the semi-circumferential portion 13 of the outer conductor 5 and the core crimping portions 9 of the inner conductor 6 are located in a center between the side walls 17. Furthermore, the inner conductor 6 at this time is incorporated in the dielectric 7 in such a posture that the barrel pieces 10 of the core crimping portions 9 are expanded toward the upper opening of the coupling 15.

Subsequently, the shielded cable W described above is set temporarily into the terminal fitting T from above. At that time, the core 1 is placed on the bottom surfaces of the core crimping portions 9, the exposed inner sheath 2 is placed on the bottom plate 21 of the rear linking walls 20, the braided wire 3 is placed on the braided wire barrel pieces 23 of the braided wire crimping portion 22 and an end part of the outer sheath 4 is placed on the bottom surfaces of the outer sheath barrel pieces 26 of the outer sheath crimping portion 25.

The terminal fitting T having the shielded cable W temporarily set therein, as described above, is placed in the unillustrated crimping machine (crimper, anvil) and crimped. Thus, the braided wire barrel pieces 23 are caulked to the exposed braided wire 3 such that end parts of the braided wire barrel pieces 23 overlap in the thickness direction. Further, the outer sheath barrel pieces 26 are caulked to the end part of the outer sheath 4 while being offset from each other in the front-rear direction.

Figure 4:
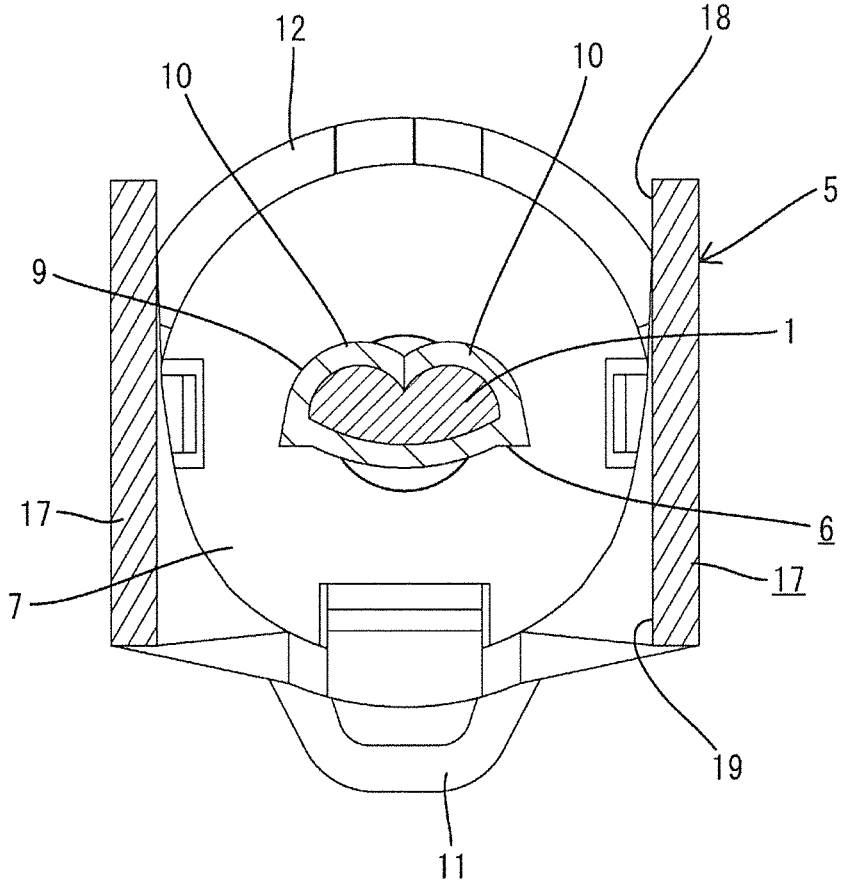
FIG. 4 is a section along A-A of FIG. 3.

As described above, the coupling 15 of the outer conductor 5 is open both upward and downward by having the upper and lower openings 18, 19 (see FIG. 4). Thus, the crimping machine can enter the coupling 15 in the vertical direction and can caulk the barrel pieces 10 of the inner conductor 6 to the exposed core 1. At this time, the tips of the barrel pieces 10 are pierced to bite into the outer peripheral surface of the core 1. In this way, the terminal fitting T is connected to the shielded cable W. As just described, in this embodiment, a crimping operation for the core 1 and a crimping operation for the braided wire 3 and the outer sheath 4 are performed simultaneously.

Subsequently, the cover 8 is mounted on the terminal fitting T. The cover member 8 is applied to an upper surface of the terminal fitting T with the front and rear clamping pieces 30, 34 expanded. At this time, the closing plate 27 of the cover 8 and the linking closing portion 28 are fit and put to the upper opening 18 of the coupling 15 in the outer conductor 5. Simultaneously, the front-side holding portion 29 is applied to the outer peripheral surface of the cut portion of the outer conductor 5 (outer peripheral surface of the rear end part of the dielectric 7) and the rear-side holding portion 33 is applied to the braided wire crimping portion 22.

Figure 9:
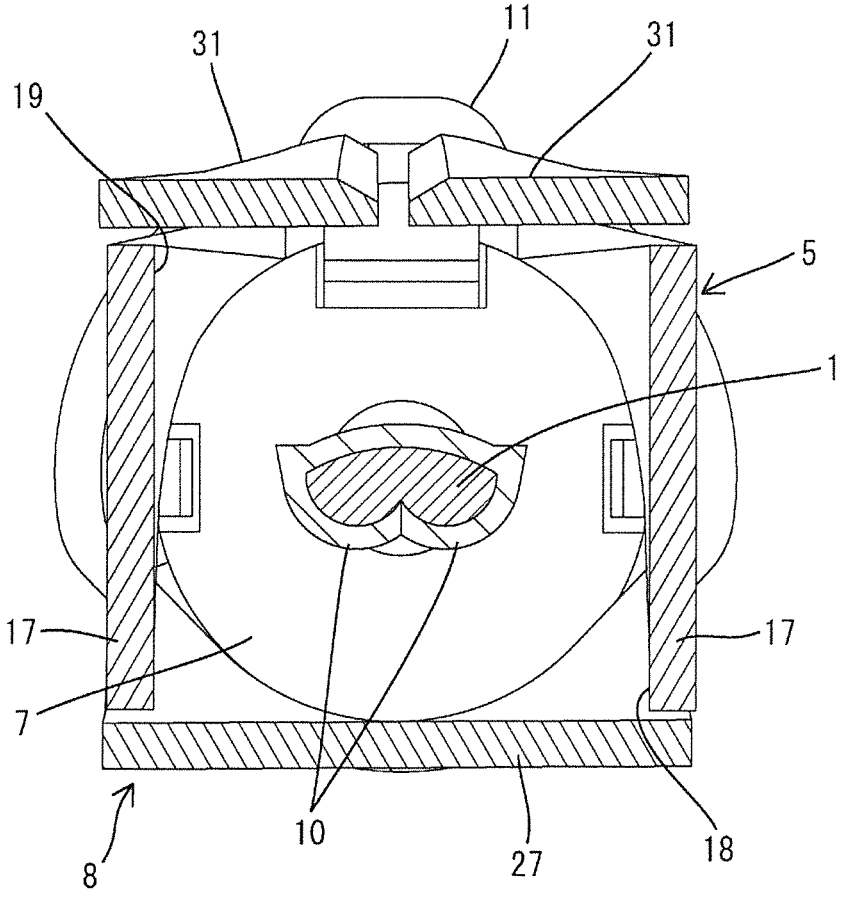
FIG. 9 is a section along C-C of FIG. 7.
Figure 10:
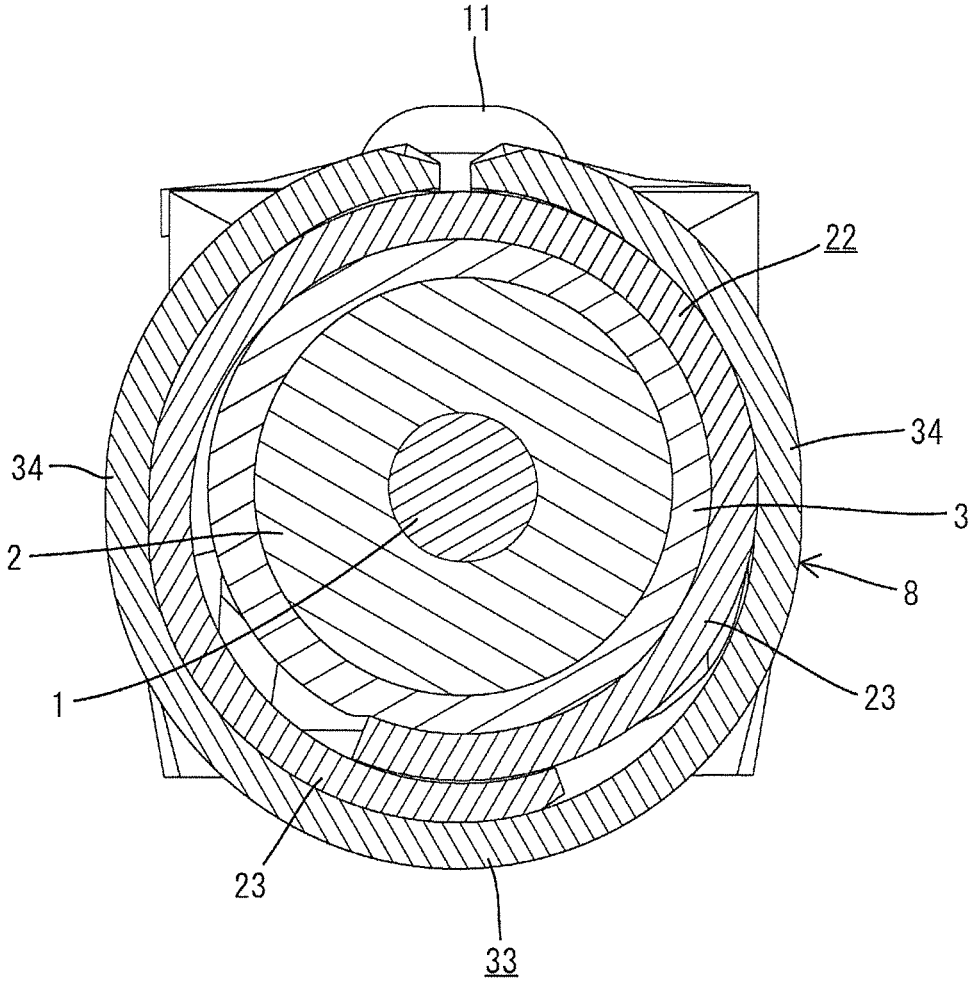
FIG. 10 is a section along D-D of FIG. 7.

In this state, the front-side clamping pieces 30 are caulked to the outer peripheral surface of the semi-circumferential portion 13 of the outer conductor 5 and the rear-side clamping pieces 34 are caulked to the outer peripheral surface of the braided wire crimping portion 22. The cover 8 is mounted on the terminal fitting T in this way. In conjunction with caulking at this time, the left and right side edges of the closing arms 31 are butted against each other along the front-rear direction. Thus, the lower opening 19 of the outer conductor 5 is closed with almost no clearance (see FIGS. 6 and 9).

Effects of this embodiment are as follows.

The parts of the outer conductor 5 corresponding to the core crimping portions 9 of the inner conductor 6 are open vertically. Thus, the core 1 of the shielded cable W can be crimped inside the outer conductor 5. Accordingly, the core 1, the braided wire 3 and the outer sheath 4 can be crimped in one process, thereby enhancing efficiency in connecting the terminal fitting T and the shielded cable W.

Further, the upper and lower openings 18, 19 of the outer conductor 5 are closed by the cover member 8 after the shielded cable W and the terminal fitting T are connected.

Thus, a reduction of a shielding function in association with the provision of the openings 18, 19 can be prevented.

Further, a short circuit between the core 1 and the braided wire 3 is avoided by interposing the exposed part of the inner sheath 2 between the exposed core 1 and braided wire 3 on the end part of the shielded cable W. Thus, the coupling 15 of the outer conductor 5 is open up to an area corresponding to the exposed part of the inner sheath 2. Accordingly, an opening in this part is also closed by the connecting wall 32 of the cover 8 (lower side is closed by the bottom plate 21) in this embodiment and all measures are taken to keep the shielding function.

Furthermore, the rear-side clamping pieces 34 of the cover 8 are caulked to the braided wire barrel pieces 23 crimped to the braided wire 3 of the shielded cable W. Thus, the braided wire barrel pieces 23 cannot open, which contributes to an increase of a force for holding the shielded cable W. Further, since the cover 8 is formed with the front-side clamping pieces in addition to these rear-side clamping pieces 34, and these front-side clamping pieces are caulked to the body 12 of the outer conductor 5, the terminal fitting T has a double structure at front and rear positions to enhance the rigidity of the entire terminal fitting T.

Further, the closing arms 31 are formed within the width of the front-side holding portion 29, which contributes to an increase in the yield of the cover 8.

The invention is not limited to the above described and illustrated embodiment. For example, the following embodiments also are included in the scope of the invention.

Although the crimping operation for the core 1 and the crimping operation for the braided wire 3 and the outer sheath 4 are simultaneously performed in the above embodiment, the respective crimping operations may be temporally shifted as long as these crimping operations are performed in the same crimping process.

Although the body 12 of the outer conductor 5 has a hollow cylindrical shape in the above embodiment, the body 12 may have a rectangular tube shape. Further, the locking protrusion 11 may be formed on the outer conductor 5 instead of being formed on the dielectric 7.

LIST OF REFERENCE SIGNS

1 . . . core
2 . . . inner sheath
3 . . . braided wire
4 . . . outer sheath
5 . . . outer conductor
6 . . . inner conductor
7 . . . dielectric
8 . . . cover
9 . . . core crimping portion
12 . . . body
18, 19 . . . opening
22 . . . braided wire crimping portion
23 . . . braided wire barrel piece
29 . . . front-side holding portion
30 . . . front-side clamping piece
31 . . . closing arm
33 . . . rear-side holding portion
W . . . shielded cable
T . . . terminal fitting

The invention claimed is:

1. A terminal fitting, comprising:

an inner conductor made of conductive metal and including a core crimping portion to be crimped to a core exposed on an end of a shielded cable;

a dielectric made of an insulating material and accommodating the inner conductor;

an outer conductor including a body configured to surround the dielectric, a braided wire crimping portion crimpable to a braided wire exposed by removing an outer sheath on the end of the shielded cable over a predetermined range, and a coupling configured to connect the body and the braided wire crimping portion, parts of the coupling corresponding to the core crimping portion defining first and second openings open in opposite first and second directions along a crimping direction of the core crimping portion; and a cover made of conductive metal and having a closing plate and first and second clamping pieces projecting from opposite side edges of the closing plate, ends of first and second clamping pieces spaced from the closing plate defining closing arms, the cover being coupled to the outer conductor by crimping the first and second clamping pieces to the outer conductor with the closing plate closing one of the first and second openings and the first and second closing arms closing the other of the first and second openings.

2. The terminal fitting of claim 1, wherein the braided wire crimping portion is composed of first and second braided wire barrel pieces, and the cover is formed with a rear-side holding portion to be crimped to the braided wire barrel pieces from outside in a state where the braided wire is crimped.

3. The terminal fitting of claim 1, wherein the cover is formed with a front-side holding portion to be crimped to an outer peripheral surface of the body.

4. The terminal fitting of claim 3, wherein:

the first and second clamping pieces are formed on the front side holding portion and extending forward from a front end of the closing plate, to be crimped to the outer peripheral surface of the body and protruding in a width direction and the first and second closing arms extend rearward within a width of the front-side holding portion from rear edges of the first and second clamping pieces.

5. The terminal fitting of claim 1, wherein:

the shielded cable is such that an inner sheath is exposed over a predetermined range between the core and the braided wire both in an exposed state;

at least one of the first and second openings of the outer conductor is open over a range including the core crimping portion and an exposed part of the inner sheath; and the cover closes the first and second openings to conceal the core crimping portion and the exposed part of the inner sheath.

* * * * *